US012466638B2

(12) United States Patent
Grönholm et al.

(10) Patent No.: US 12,466,638 B2
(45) Date of Patent: Nov. 11, 2025

(54) WALL ELEMENT

(71) Applicant: K. Hartwall Oy Ab, Söderfulla (FI)

(72) Inventors: Jack Grönholm, Söderkulla (FI); Thomas Oriander, Söderkulla (FI); Mikko Järvi, Söderkulla (FI)

(73) Assignee: K. Hartwall Oy Ab, Söderkulla (FI)

( * ) Notice: Subject to any disclaimer, the term of this patent is extended or adjusted under 35 U.S.C. 154(b) by 525 days.

(21) Appl. No.: 17/749,187

(22) Filed: May 20, 2022

(65) Prior Publication Data

US 2022/0371817 A1 Nov. 24, 2022

(30) Foreign Application Priority Data

May 21, 2021 (SE) ..... 2150648-0

(51) Int. Cl.

| | |
|---|---|
| ***B65D 90/08*** | (2006.01) |
| ***B65D 88/12*** | (2006.01) |
| ***B65D 90/02*** | (2019.01) |

(52) U.S. Cl.

CPC ..... *B65D 90/08* (2013.01); *B65D 88/12* (2013.01); *B65D 90/021* (2013.01)

(58) Field of Classification Search

CPC ..... B65D 90/08; B65D 88/12; B65D 90/021; B65D 2519/00024; B65D 2519/00029; B65D 2519/00059; B65D 2519/00064; B65D 2519/00094; B65D 2519/00099; B65D 2519/00164; B65D 2519/00169; B65D 2519/00174; B65D 2519/00184; B65D 2519/00199; B65D 2519/00203; B65D 2519/00208; B65D 2519/00218; B65D 2519/00273; B65D 2519/00323; B65D 2519/00333; B65D 2519/00502; B65D 2519/00532; B65D 2519/00611; B65D 2519/00661; B65D 2519/00711; B65D 2519/00995; B65D 19/06; B65D 90/02; B65D 90/023; B65D 2519/0099; B65D 2590/0075; B62D 33/046

See application file for complete search history.

(56) References Cited

U.S. PATENT DOCUMENTS

| | | | | |
|---|---|---|---|---|
| 2,965,276 A | | 12/1960 | Foster | |
| 3,266,656 A | | 8/1966 | Kridle | |
| 3,712,504 A | * | 1/1973 | Petersen | B65D 7/12 220/668 |
| 6,488,167 B1 | | 12/2002 | Napp | |
| 2006/0175227 A1 | | 8/2006 | Lau | |

(Continued)

FOREIGN PATENT DOCUMENTS

| | | |
|---|---|---|
| CN | 203372661 U | 1/2014 |
| DE | 2109666 A1 | 9/1971 |

(Continued)

*Primary Examiner* — Andrew D Perreault

(74) *Attorney, Agent, or Firm* — Laine IP Oy

(57) ABSTRACT

According to a first aspect of the present disclosure, there is provided a wall element for a load carrier. The wall element has a body with a frame, which defines at least one opening. The wall element features at least one panel for covering the at least one opening of the frame. The wall element further features a cover strip for detachable attachment to the body through a reversible attachment interface between the cover strip and the body to secure the at least one panel to the at least one opening.

13 Claims, 10 Drawing Sheets

(56) References Cited

U.S. PATENT DOCUMENTS

| | | | | |
|---|---|---|---|---|
| 2009/0026215 | A1* | 1/2009 | Roush | B60P 7/0815<br>220/652 |
| 2009/0032530 | A1* | 2/2009 | Chu | B65D 88/528<br>220/4.28 |

FOREIGN PATENT DOCUMENTS

| | | | |
|---|---|---|---|
| DE | 29718974 | U1 | 3/1998 |
| EP | 0894728 | A2 | 2/1999 |

* cited by examiner

WALL ELEMENT

FIELD

The present disclosure relates to the field of logistics equipment. In particular, the disclosure relates to load carriers with replaceable panels.

BACKGROUND

Load carriers, such as crates and roll containers, are subject to heavy use. It is not uncommon for the elements of a crate to with stand heavy impacts during its life span. Some impacts are so forceful that the require replacement of an element. A common example of such a scenario is a wall element penetrated by a lifting fork of a forklift. Indeed, the wall elements are the most vulnerable part of a load carrier. However, typical wall elements are designed and built for a fully equipped service bay that include tools not available on sites that the load carriers are actually used. For example, removal of a conventional panel may require drilling out rivets and installing new ones, while very few logistics centers carry the necessary drilling and riveting equipment for performing the replacement. Too often, therefore, the damaged load carrier must be removed from the active fleet and transported for service.

Accordingly it would be beneficial to construct a load carrier with a wall element suitable for service without, or with rudimentary, tools in situ.

SUMMARY

The invention is defined by the features of the independent claims. Some specific embodiments are defined in the dependent claims.

According to a first aspect of the present disclosure, there is provided a wall element for a load carrier. The wall element has a body with a frame, which defines at least one opening. The wall element features at least one panel for covering the at least one opening of the frame. The wall element further features a cover strip for detachable attachment to the body through a reversible attachment interface between the cover strip and the body to secure the at least one panel to the at least one opening.

According to a second aspect of the present disclosure, there is provided a load carrier featuring a base and at least one such wall element.

According to a third aspect of the present disclosure, there is provided a method of installing a panel into such a wall element, in which method:

- the panel is bent into a non-planar state,
- the panel is inserted into a receptive groove of the frame of the body of the wall element, and
- the panel is secured into the frame by attaching the cover strip onto the panel and frame through the reversible attachment interface between the cover strip and the body.

According to a fourth aspect of the present disclosure, there is provided a method of replacing a panel of such a wall element, in which method:

- an old panel is released from the frame of the by detaching the cover strip from the panel frame through the reversible attachment interface,
- the old panel is removed from a receptive groove of the frame, and
- a new panel is installed by bending the new panel into a non-planar state, inserting the new panel into the receptive groove of the frame of the body of the wall element, and securing the panel into the frame by attaching the cover strip onto the new panel and frame through the reversible attachment interface.

One or more than one embodiment may include one or more than one feature from the following itemized list:

- the cover strip comprises a first counterpart of the attachment interface;
- the first counterpart is an integral part of the cover strip;
- the body comprises a second counterpart of the attachment interface;
- the second counterpart is an integral part of the body;
- the first counterpart is a male counterpart;
- the second counterpart is a female counterpart;
- the counterparts are configured to form a form-locking fit without a penetrative affixer;
- the first counterpart is a locking tab;
- the second counterpart is a slot, in which the locking tab may be inserted and locked;
- the counterparts form a form-locking fit;
- the locking tab is configured to be secured to the slot through folding of the locking tab;
- the frame comprises a groove, in which edges of the at least one panel are inserted and enclosed;
- the at least one panel is bendable between a use configuration, in which the at least one panel exhibits a planar shape across the at least one opening, and a service configuration, in which the panel is bent to a non-planar state for releasing or introducing the panel into the receptive groove of the frame;
- the at least one panel comprises four lateral edges;
- each of the corners between the edges comprises a relief, such as a cut-out, chamfer, or rounding, for facilitating insertion and removal of the at least panel to and from the groove of the frame;
- the edges of the at least one panel are covered by the frame and the cover strip;
- the body comprises a divider;
- the divider extends across the frame and divides the space delimited by the frame into two openings each configured to receive a panel;
- the cover strip is configured to be attached to the divider for securing both panels to the body;
- the panel comprises a plastic sheet, e.g. honey comb or channel plastic sheet,
- the load carrier is a logistic load carrier intended to contain parcelled items for storage and/or transport.

Considerable benefits are gained with aid of the present proposal.

Because the panel or panels may be attached to the body of the wall element through a reversible attachment interface between the body and the cover strip, panels may be replaced without or rudimentary with tools in situ, which considerably improves the serviceability of such load carriers.

According to an embodiment the edges of the panel or panels is/are covered by the cover strip and frame of the wall element, which makes the side of the wall element relatively smooth thus minimizing risk of damage to the goods being transported.

BRIEF DESCRIPTION OF THE DRAWINGS

In the following certain exemplary embodiments are described in greater detail with reference to the accompanying drawings, in which.

EMBODIMENTS

In the present context, the term "reversible" refers to the ability to be undone repeatedly. As will later transpire, the attachment interface between the cover strip and the body of the wall element is reversible in that the cover strip may be attached to and detached from the body without destructive disassembly, such drilling out rivets.

Figure 1:
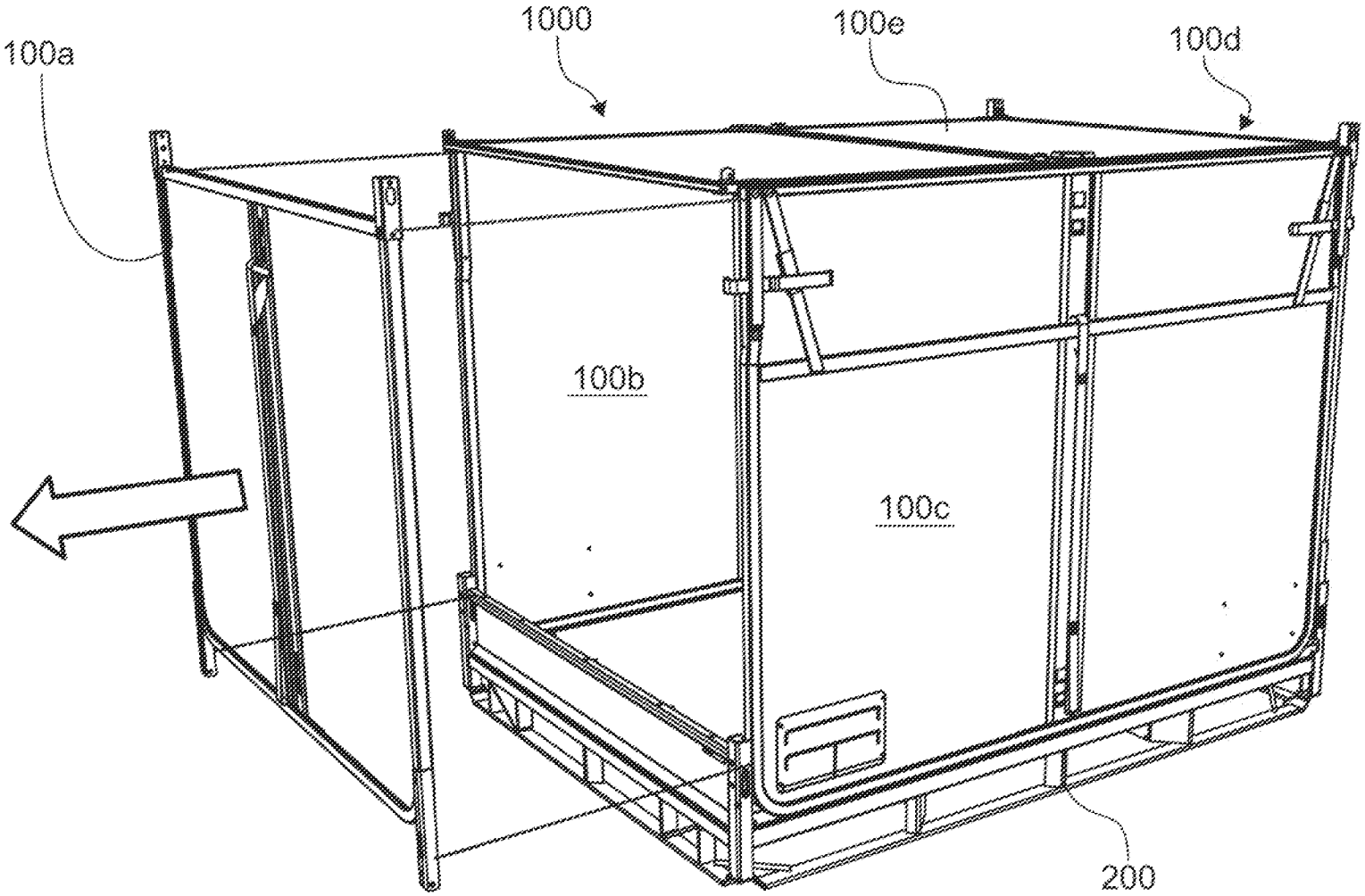
FIG. 1 illustrates a perspective view of a load carrier including a wall element in accordance with at least some embodiments.

FIG. 1 illustrates an exemplary embodiment of a load carrier 1000 in accordance with at least some embodiments of the present disclosure. The depicted load carrier 1000 is a logistics crate assembled on a pallet-sized base 200. Naturally, the shape and size of the crate may be varied as can be the base 200, which may be made of metal, as illustrated, or it may take the form of a wooden pallet. The illustrated embodiment does not contain wheels but the present concept is equally applicable to wheeled platforms as well, e.g. to roll containers.

The illustrated load carrier 1000 has four lateral wall elements 100, one of each lateral side of the base 200. Throughout the present disclosure a given element of the load carrier 1000 is provided with a consistent reference sign. Where there are more than one of such elements, e.g. four lateral wall elements, different similar elements are distinguished with a successive letter suffix. In the case of the wall elements, there is a first wall element 100*a*, a second wall element 100*b*, a third wall element 100*c*, and a fourth wall element 100*d*. The load carrier 1000 also includes a top wall element 100*e* opposing the base 200 and connecting the lateral wall elements 100, 100*b*, 100*c*, 100*d* across the top opening of the load carrier 1000. The wall elements 100 are detachably connected to each other and to the base 200 by means of latches generally known in the art. In the illustrated example the short side wall elements 100*a*, 100*d* are connected through a pivot mechanism, which is attached to the base 200. The long side wall elements 100*b*, 100*c* are detachably hinged to the base 200 to allow for collapsing the unit in empty transportation.

The one or more of wall elements 100 include(s) one or more replaceable panel(s) 120. In the following the construction enabling easy replacement of a panel is described in connection with the first wall element 100*a* but the teaching is equally applicable to any one of the wall elements 100*a* . . . 100*e*.

FIG. 1 shows the first wall element 100*a* detached from the load carrier 1000 for replacement of the panels 120 on the wall element 100*a*. The removal of the wall element 100 for replacement of a panel 120 may not be compulsory, if the wall element 100 is hinged, for example. In the present embodiment the wall element 100 is removed for unobtrusive access to both sides of the wall element 100.

Figure 2:
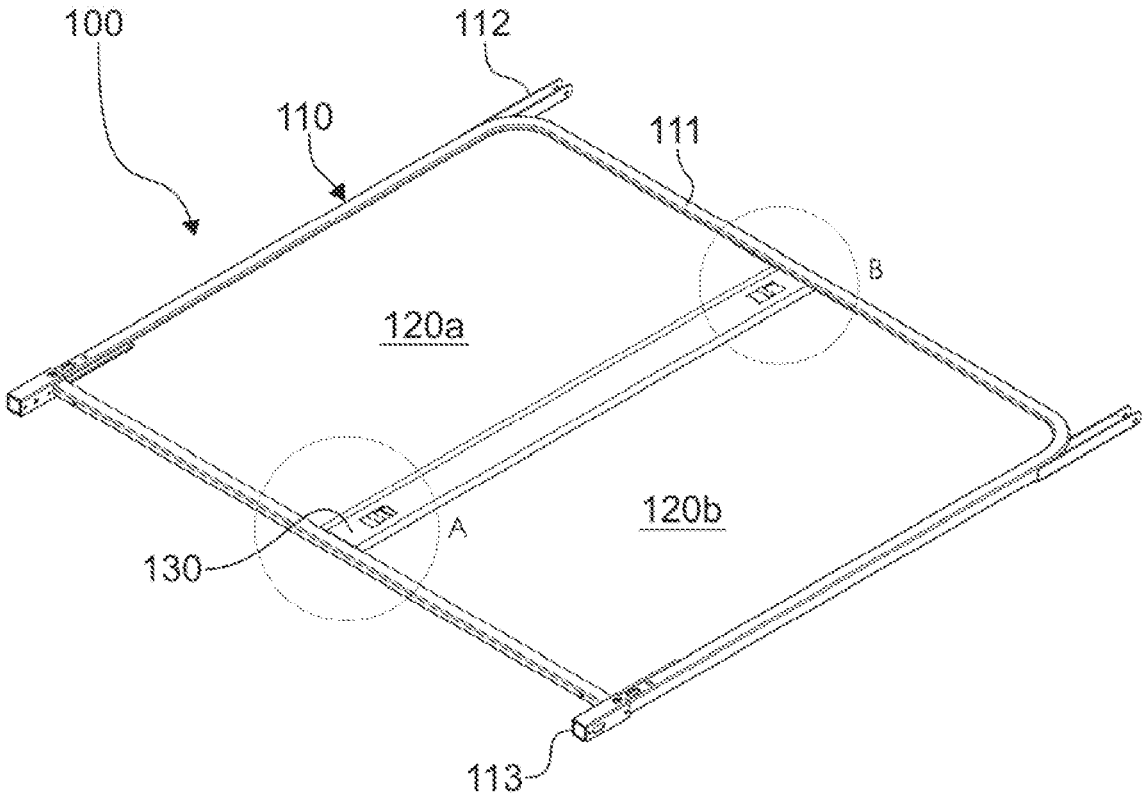
FIG. 2 illustrates a perspective view of a wall element of the load carrier of FIG. 1.
Figure 3A:
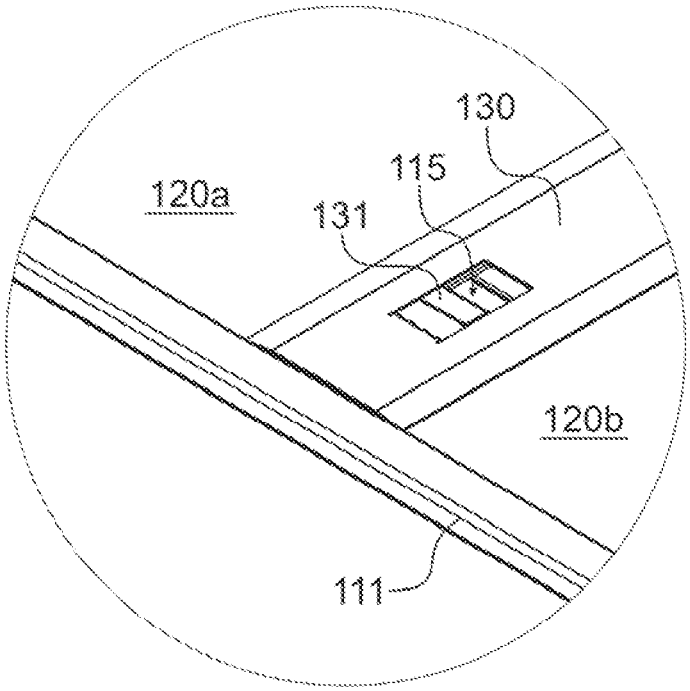
FIG. 3A illustrates a perspective detail view of area A of FIG. 2.
Figure 3B:
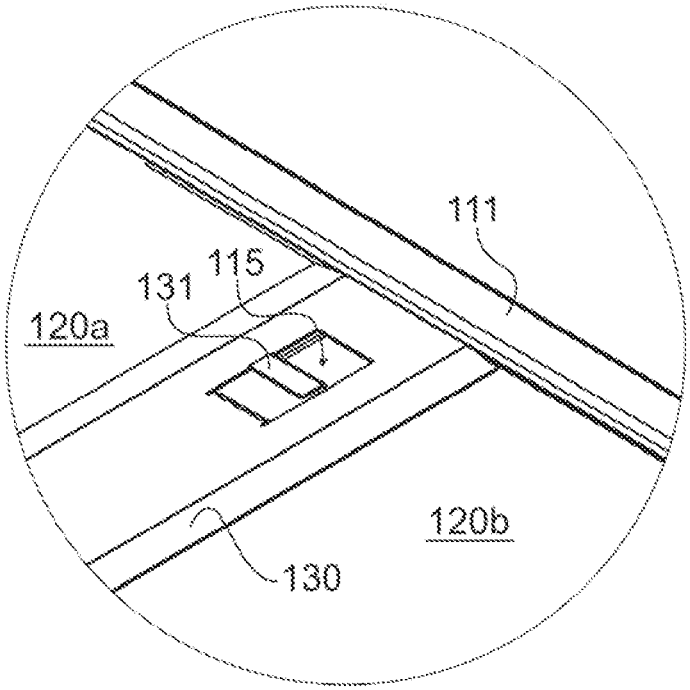
FIG. 3B illustrates a perspective detail view of area B of FIG. 2.
Figure 4A:
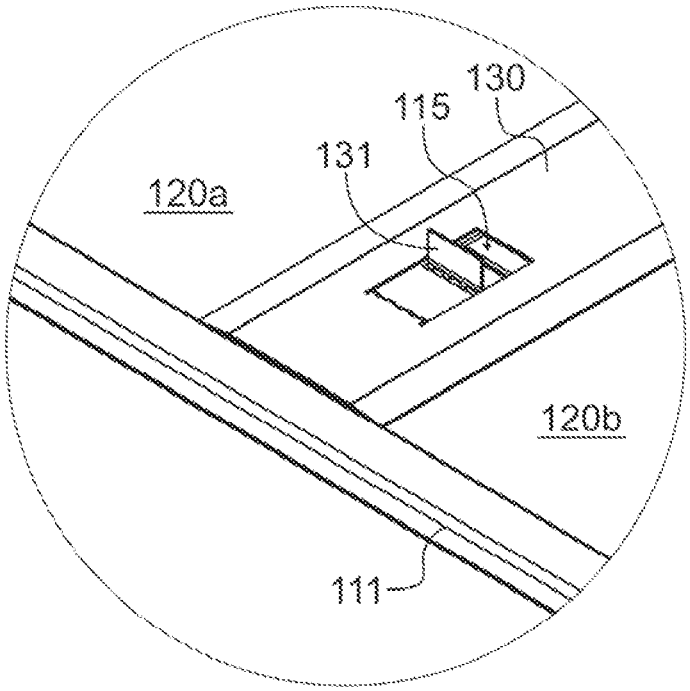
FIG. 4A illustrates a perspective detail view of area A of FIG. 2 with the locking tab of the cover strip folded up.
Figure 4B:
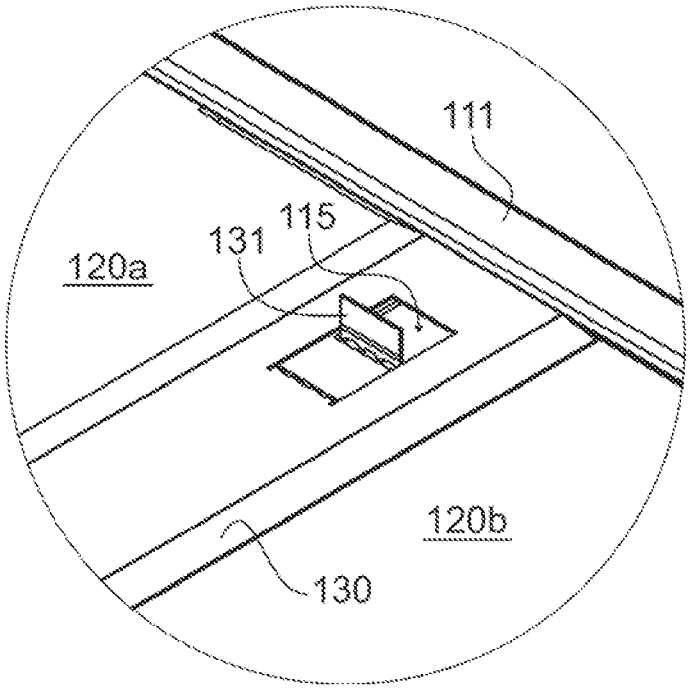
FIG. 4B illustrates a perspective detail view of area B of FIG. 2 with the locking tab of the cover strip folded up.

FIG. 2 shows the wall element 100 is a removed and assembled state.

Figure 9:
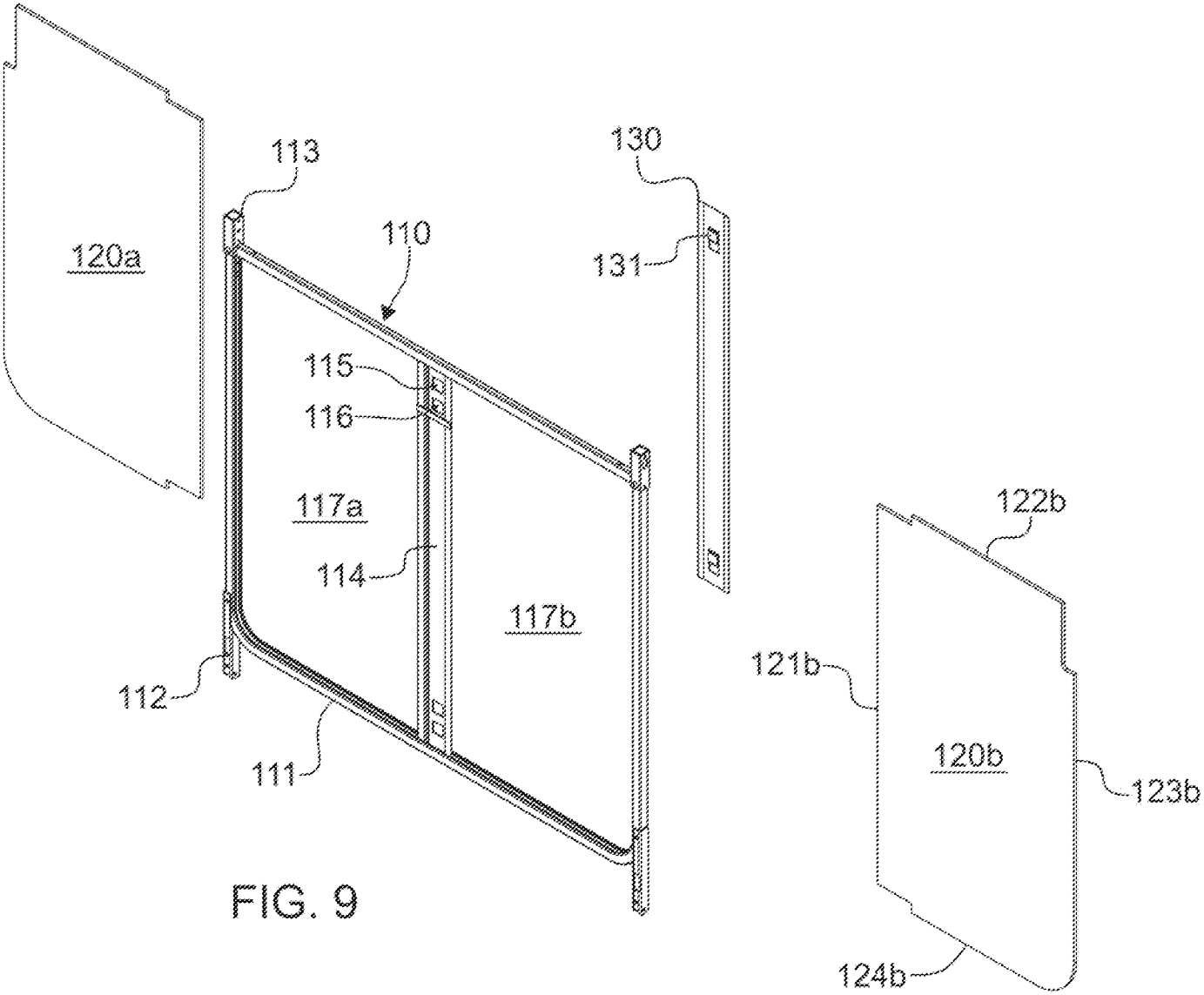
FIG. 9 illustrates a perspective exploded view of the wall element of FIG. 2.

FIG. 9 shows the wall element 100 is a removed and disassembled state. FIG. 9 illustrates the basic four components of a two-panel construction, namely a generally quadrilateral base 110, two generally quadrilateral panels 120, and a cover strip 130. The base 110 may be constructed of metal, such as constructional steel or aluminium alloy. The base 110 features a frame 111 for housing the panel or panels 120. Accordingly, the frame 111 has a groove for receiving an edge or edges of the panel 120. It may be efficient to construct the frame 111 of a C-shaped profile, whereby the groove is incorporated into the profile. The body 110 also has extensions protruding from the frame 111 for attachment into the host load carrier 1000. In the illustrated embodiment the body 110 features two bottom extensions 112 provided to the two bottom corners of the body 110 and two top extensions 113 provided to the two top corners of the body 110 that oppose the bottom extensions 112. The extensions 112, 113 may be constructed from a profile different or similar to that of the frame 111. According to the illustrated embodiment, the profile of the extensions 112, 113 is closed as opposed to the open profile of the frame 111. The extensions 112, 113 may be attached to the frame 111 with affixers, such as rivets, or welded, glued, or otherwise bonded thereto.

The frame 111 defines an opening 117, which may be divided into several openings by one or more than one divider 114 that extends or extend across the frame 111. In the illustrated embodiment the central divider 114 extends across the frame 111 to divide the opening 117 into two adjacent openings, namely a first opening 117*a* and a second opening 117*b*. The shape and size of the openings 117*a*, 117*b* is defined by the shape and size of the frame 111 and divider 114.

The divider 114 may take the form an elongated strip, which is placed and secured into the groove of the frame 111. The divider 114 may be constructed from a sheet of metal, such as constructional steel or aluminum alloy, and it may include a creased profile for added rigidity and for creating a space for accepting the panel 120. More specifically, the profile of the divider 114 features a central web and peripheral flanges on either side of the web through a fold there between. Accordingly, the flanges are aligned with one another and the web is displaced from that line towards one side of the profile. The divider includes one or more than one slot 115, 116, the shape and operation of which will be explained here after in greater detail. The purpose of the slots 115, 116 is to form a counterpart in an attachment interface between the cover strip 130 and the body 110. The slots 115, 116 are integral features of the divider 114.

The openings 117*a*, 117*b* are intended to be occupied by panels 120*a*, 120*b*. The panels 120 are constructed from a material, which is strong enough to withstand forces required to keep the contents of the load carrier 1000 inside. Preferably the panels 120 are made to be self-supporting, meaning that they can withstand their own weight without buckling. The panels 120 may be made, for example, of relatively pliable material, such as plastic sheet, channel plastic sheet, honeycomb plastic sheet, plywood, or comparable material. It is in any case preferable to construct the panels 120 of a material, which is able to experience noticeable elastic deformation without breaking. In other words, the panel 120 is flexible.

The panels 120 include four lateral edges, namely a first edge 121, a second edge 122, a third edge 123, and a fourth edge 124 forming the generally quadrilateral shape of the panel 120. FIG. 9 shows the panels 120*a*, 120*b* in a normal resting state, wherein the panels 120*a*, 120*b* exhibit a generally planar appearance. As already implied, the shape and size of the panels 120*a*, 120*b* is defined by the openings 117*a*, 117*b*. Accordingly, one of the corners of the panel, namely the corner between the third edge 123 and the fourth edge 124 includes a rounding to match the rounding in one corner of the frame 111. There is a cut-out in the corner between the second edge 122*b* and the third edge 123*b* for providing clearance inside the frame 111 for operating a locking mechanism used to lock the walls to each other. The rest of the corners of the panel 120 include a different relief in the form of a cut-out, the function of which will transpire hereafter.

Generally speaking, the panel 120 is set to be inserted into the space defined by the frame 111 and the divider 114. More specifically, the panel 120 is set to be inserted into the receptive groove of the frame 111. When installed, the edges 122, 123, 124 of the panel 120 that are inserted into the groove are not visible from the outside but rather covered by the frame 111. However, to minimize sharp edges in the wall element, the profile of the frame 111 is made as thin as practical for a smooth transition between the frame 111 and the panel 120.

FIG. 9 further shows cover strip 130 detached from the body 110. The purpose of the cover strip 130 is to attach the panel or panels 120*a*, 120*b* to the body 110 and to cover the edge 121 not covered by the frame 111. The cover strip 130 resembles the divider 114 by construction and dimensions. The cover strip 130 features counterpart shape cooperating with that of the divider 114 for forming the attachment interface between the cover strip 130 and the body 110. In the embodiment of FIGS. 1 to 9 the counterpart shape is a locking tab 131. The locking tab 131 may be formed by punching a strip out of the sheet metal with one end attached to the cover strip 130 to expose a punch hole 132. The locking tab 131 is an integral part of the cover strip 130, wherein the locking tab 131 may not be non-destructively detached from the cover strip 130.

FIGS. 2, 3A, 3B, 4A, and 4B show the design of and interaction between the cooperating counterparts on the divider 114 and the cover strip 130 in greater detail.

FIG. 2 shows the wall element 100 in an assembled state, in which the edges of the panels 120*a*, 120*b* are covered by the frame 111 as well as the cover plate 130 on one side and the divider 114 on the other side. FIGS. 2, 3A, 3B, 4A, and 4B show the fagade side of the wall element 100 with the cover strip 130 covering the first edge of the panel 120. The FIGS. 2, 3A, 3B, 4A, and 4B illustrate firstly that the divider 114 as two slots 115, 116 arranged at both ends of the divider 114. One slot 116 acts as an entry slot for the locking tab 131, whereas the other slot 115 acts as an exit slot. The locking tab 131 may have a straight initial shape (FIGS. 5, 6A, 6B) and may be folded for securing the cover strip 130 into the divider 114. The locking tab 131 is inserted into the entry slot 116, whereby the cover strip 130 and the divider 114 face each other. With the locking tab 131 inserted, the visible part of the locking tab 131 is folded about 90 degrees to extend along the divider 114 towards the exit slot 115 and again about 90 degrees through the exit slot 115 (FIGS. 4A and 4B), wherein locking tab 131 is one again visible on the fagade side of the wall element 100. By adding a final about 90 fold to the locking tab 131, the locking tab 131 presses against section of the divider 114, that is between the slots 115, 116 and visible through the punch hole 132 on the cover strip 130. To facilitate folding, the locking tab 131 preferably includes a weakened portion 133 at least at the final fold location.

Figures 10A, 10B:
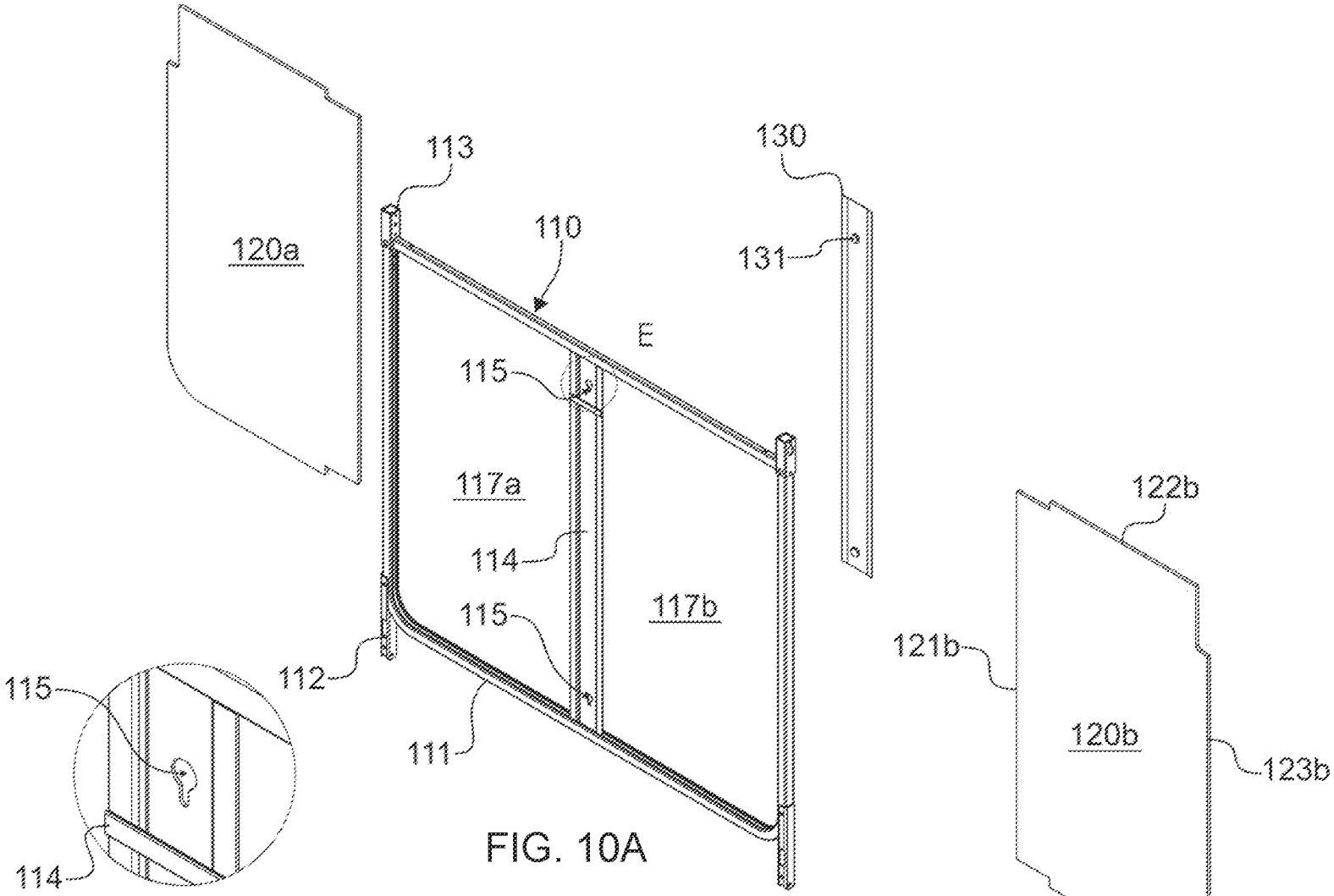
FIG. 10A illustrates a perspective exploded view of a wall element according to another embodiment.
FIG. 10B illustrates a perspective detail view of area E of FIG. 10A.

FIGS. 10A and 10B show an alternative attachment interface to the folding locking tab and slot arrangement shown in FIGS. 1 to 9. According to the alternative embodiment, the slot 115 exhibits a general keyhole shape, which is configured to receive an appropriately shaped locking tab 131. In other words, the female counterpart of the attachment interface may be varied from the embodiments shown in FIG. 1 to 9. Accordingly, the locking tab 131 features a relatively thin stem, which is able to slide into the narrow section of the slot 115, and a relatively wide head, which is only able to slide through the wide section of the slot 115 and, when slid into a locking state, prevent the detachment of the cover strip by not fitting through the narrow section of the slot 115. In other words, the male counterpart of the attachment interface may be varied from the embodiments shown in FIG. 1 to 9.

The embodiment depicted above with reference to FIGS. 1 to 10B may be varied in a host of different ways depending on the circumstances.

According to an alternative embodiment, one or more of the wall element(s) may include only one panel or more than two panels. In each of these embodiments it is advantageous to secure the sole panel or at least one of the panels to the frame with a comparable cover strip.

Alternatively or additionally, the locking tab may be pre-folded such to be slid and thus secured into an appropriately shaped slot. The pre-folded locking tab may resemble that shown in FIG. 9. When pre-folded, the locking tab only requires one receptive slot.

Alternatively or additionally, the body may not feature a divider, whereby the frame defines a solitary opening. According to such an embodiment, the cover strip may be attached to one section of the frame, which is provided with a counterpart cooperating with that of the cover strip.

Alternatively or additionally, instead of a form-locking shape in the female counterpart of the attachment interface, the attachment interface may include a male-female pair of primary elements, which are locked into each other with a tertiary component, such as a spring-loaded detent.

Alternatively or additionally, the orientation of the male and female counterparts of the attachment interface may be reversed.

Replacement of panels 120 of the wall element 100 shown in FIGS. 1 to 9 is explained here after.

First, the wall element 100 may be removed from the load carrier 1000 for service. Alternatively, access to the back side of the wall element may be gained by opening the wall element 100 via a hinge.

Figure 5:
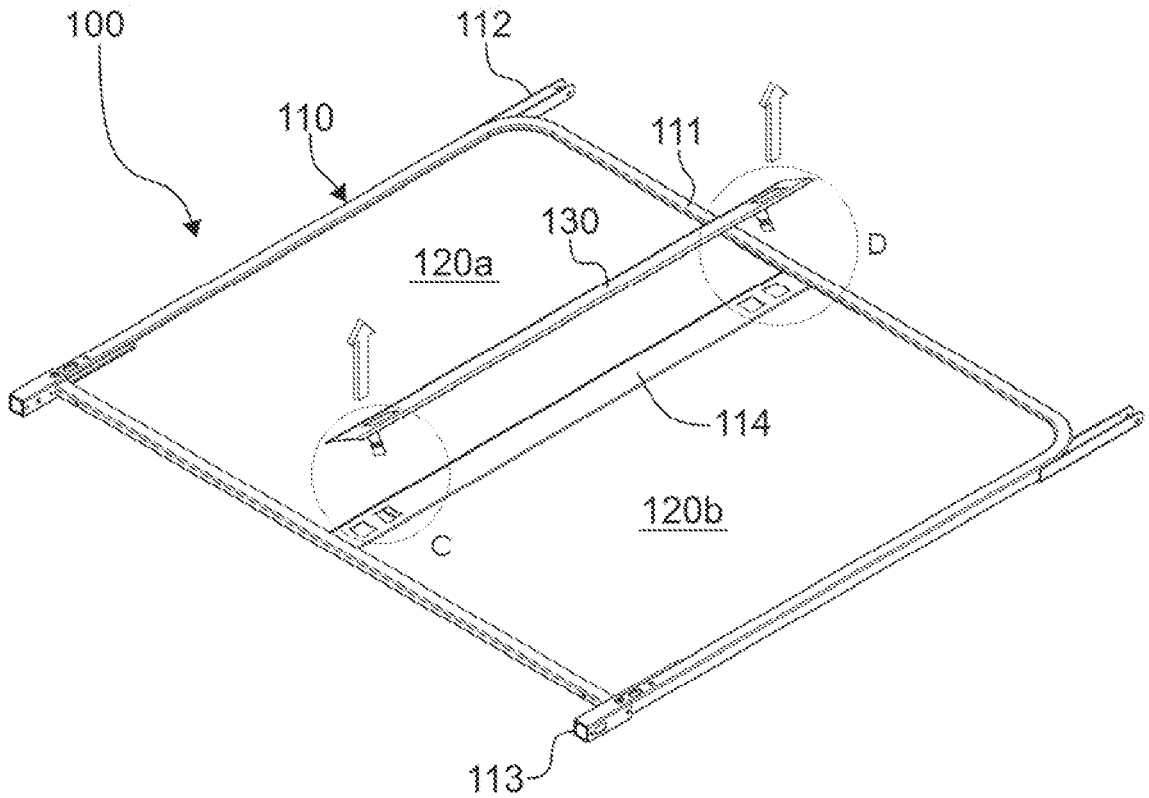
FIG. 5 illustrates a perspective view of the wall element of FIG. 2 with the cover strip detached.
Figure 6A:
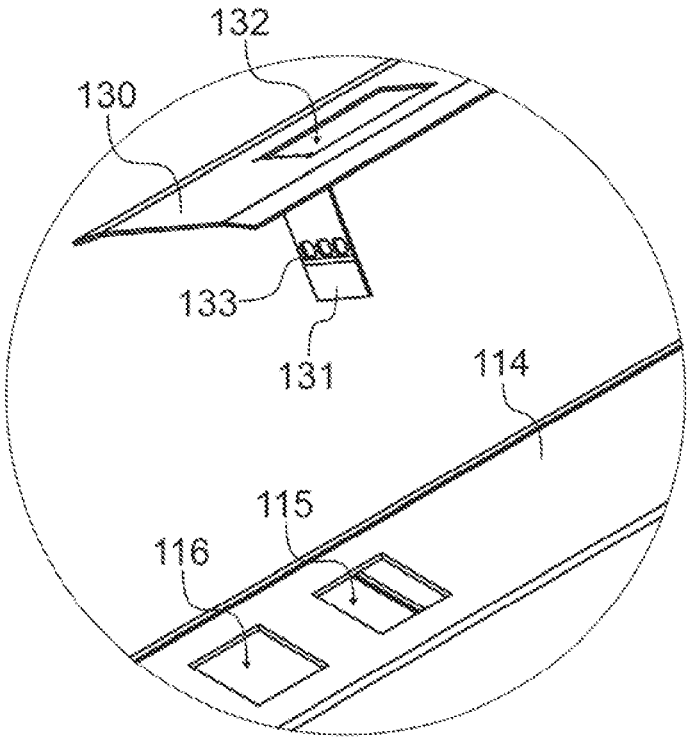
FIG. 6A illustrates a perspective detail view of area C of FIG. 5.
Figure 6B:
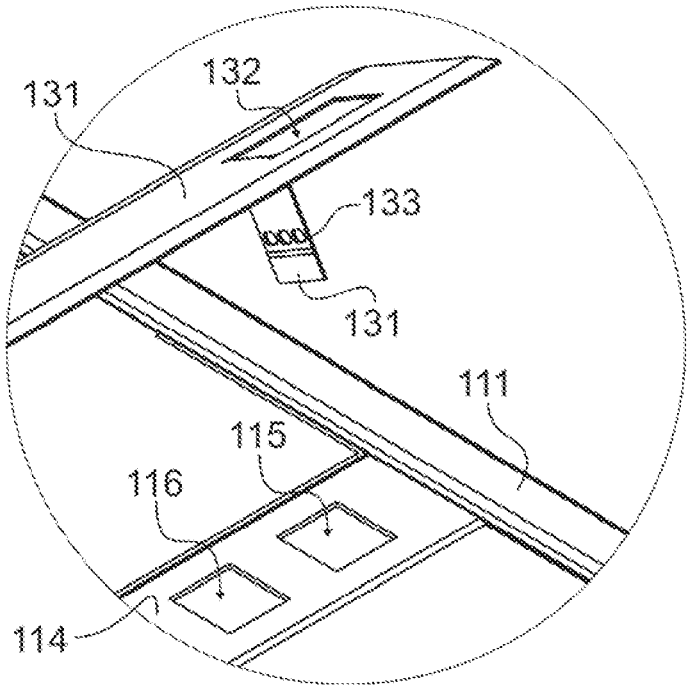
FIG. 6B illustrates a perspective detail view of area D of FIG. 5.

The removal process of the old panel begins by detaching the cover strip 130 from the divider by performing the above-described folding process of the locking tab 131 in reverse. The visible part of the locking tab 131 is folded up (FIGS. 2 to 4B) and straightened out so that the locking tab 131 may be slid out of the entry slot 116. With the locking tab 131 un-done, the cover strip 130 is lifted off the panels 120 and divider 114 (FIGS. 5 to 6B).

Figure 7:
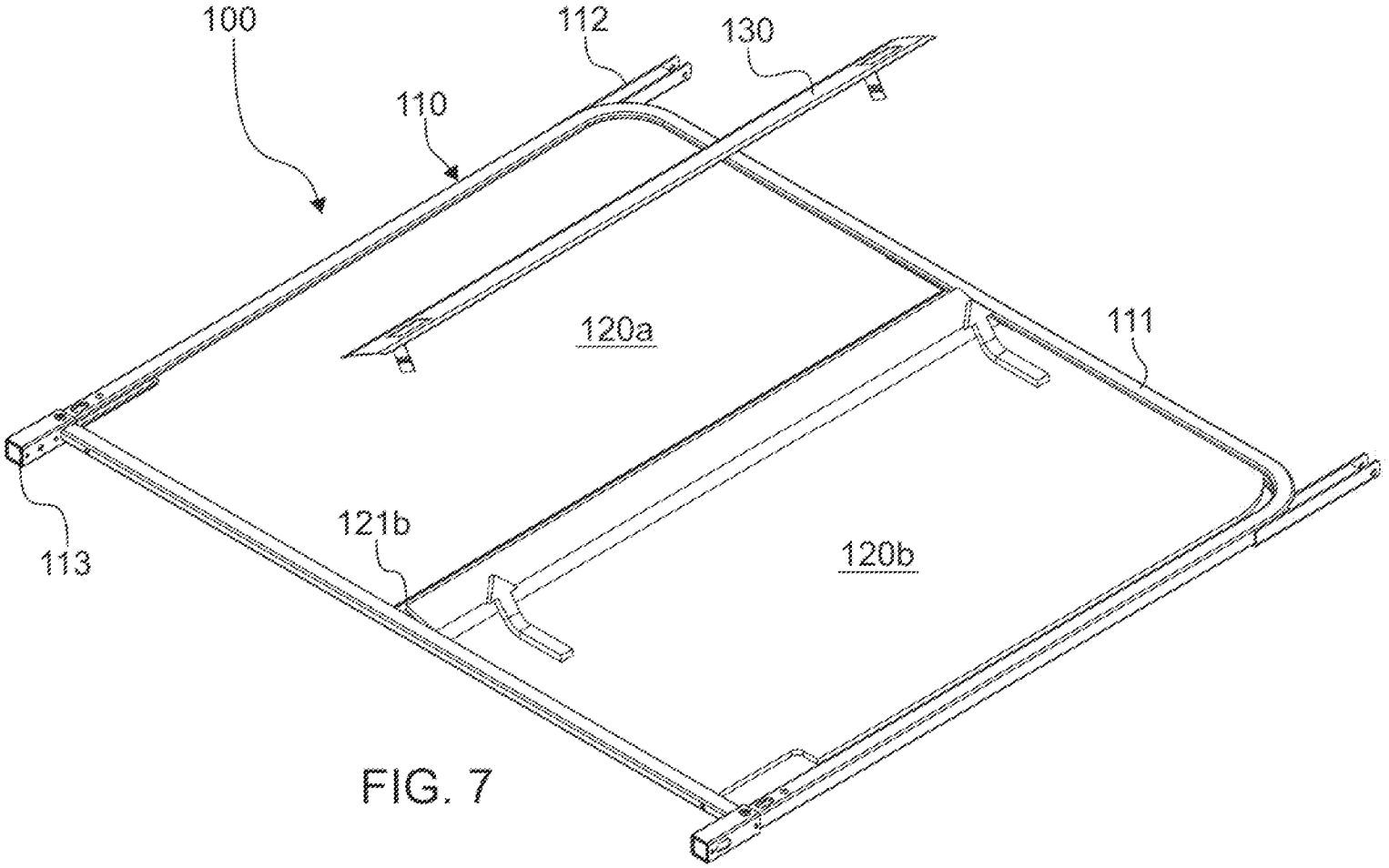
FIG. 7 illustrates a perspective view of the wall element of FIG. 5 with one panel partly slid out from the frame.
Figure 8:
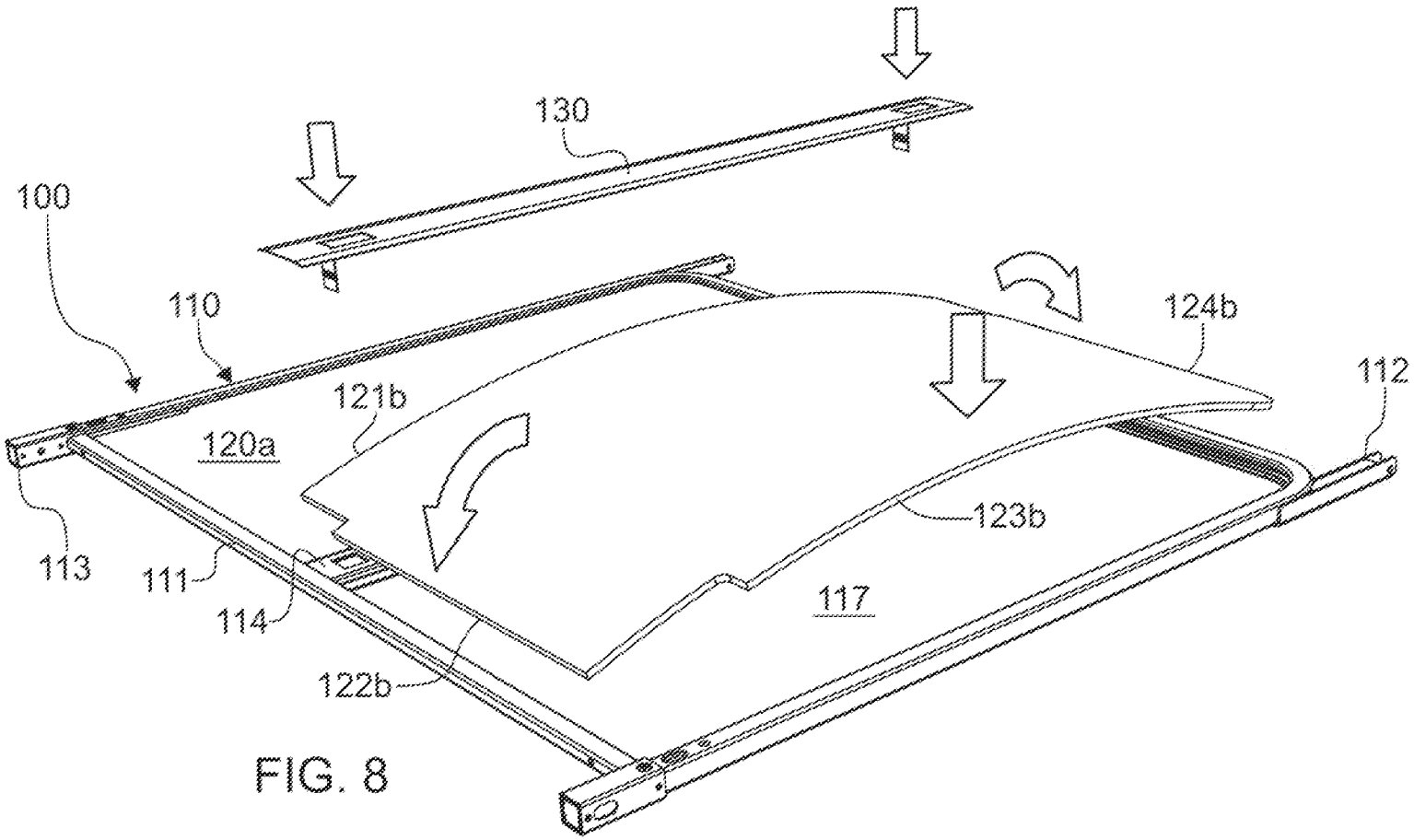
FIG. 8 illustrates a perspective view of the wall element of FIG. 5 with one panel fully slid out from the frame.

With the cover strip 130 removed (FIG. 7), the panel 120 is slid out enough to clear the corners of the panel 120 from the groove of the frame 111. The first edge 121*b* of the panel 120*b* is bent up as indicated by the arrows to clear the divider, which is facilitated by the respective corner cut-outs. The cut-outs between the first edge 121*b* and the second edge 122*b* and between the first edge 121*b* and the fourth edge 124*b* are designed to enable lifting of the first edge 121*b* by bending the panel about a first bending axis as shown in FIG. 7. This enables sliding of the panel 120*b* out of the groove of the frame 111 to expose the third edge 123*b*. By then bending the panel 120 from two opposing sides about a second bending axis into a non-planar state, such as an arc (FIG. 8), the projection length of the panel 120 may be reduced enough to clear the remaining two edges 122*b*, 124*b* of the panel 120*b* from the frame 111. The old panel 120*b* may now be removed. The other panel 120 may be removed similarly.

The new panels 120*a*, 120*b* are installed by performing the reverse. The panel 120 is bent into a non-planar state, e.g. an arc, to reduce the projection length of the panel to fit two opposing edges 122, 124 into the receptive groove of the frame 111. With the opposing edges 122, 124 in place, the panel 120 is slid into place with the third edge 123 in the groove as well. With the panels inserted, the panels 120*a*, 120*b* are secured to the body 110 by attaching the cover strip 130 as described above.

With the wall element 100 assembled (FIG. 2), the wall element 100 is reattached or closed in respect to the load carrier 1000.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

REFERENCE SIGNS LIST

| No. | Feature |
|---|---|
| 100 | wall element |
| 110 | body |
| 111 | frame |
| 112 | bottom extension |
| 113 | top extension |
| 114 | divider |
| 115 | slot (exit) |
| 116 | slot (entry) |
| 117 | opening |
| 120 | panel |
| 130 | cover strip |
| 131 | locking tab |
| 132 | punch hole |
| 133 | weakened portion |
| 200 | base |
| 1000 | load carrier |

The invention claimed is:

1. A wall element for a load carrier, comprising:

a body comprising a frame, which defines at least one opening, at least one panel, which is configured to cover the at least one opening of the frame, and a cover strip, which is configured to detachably affix to the body through a reversible attachment interface between the cover strip and the body and to secure the at least one panel to the at least one opening, wherein:

the cover strip comprises a locking tab as a first counterpart of the attachment interface, which first counterpart is an integral part of the cover strip, the body comprises a corresponding slot, in which the locking tab may be inserted and locked, as second counterpart of the attachment interface, which second counterpart is an integral part of the body, and wherein the locking tab is configured to be secured to the slot through folding of the locking tab to form a form-locking fit without a penetrative affixer.

2. The wall element according to claim 1, wherein the edges of the at least one panel are covered by the frame and the cover strip.

3. The wall element according to claim 1, wherein:

the body comprises a divider, which extends across the frame and divides the space delimited by the frame into two openings each configured to receive a panels, and wherein the cover strip is configured to be attached to the divider for securing both panels to the body.

4. The wall element according to claim 1, wherein the panel comprises a channel plastic sheet, honeycomb plastic sheet, plywood, or other sheet material, which can be bent to a non-planar state for assembly or disassembly.

5. A load carrier comprising a base and one or more than one wall element according to claim 1.

6. The load carrier according to claim 5, wherein the load carrier is a logistic load carrier intended to contain parcelled items for storage and/or transport.

7. The wall element according to claim 1, wherein the frame comprises a groove, in which edges of the at least one panel are inserted and enclosed.

8. The wall element according to claim 7, wherein the at least one panel is bendable between:

a use configuration, in which the at least one panel exhibits a planar shape across the at least one opening, and a service configuration, in which the panel is bent to a non-planar state for releasing or introducing the panel into the receptive groove of the frame.

9. The wall element according to claim 7, wherein the at least one panel comprises four lateral edges, and wherein each of the corners between the edges comprises a relief, such as a cut-out, chamfer, or rounding, for facilitating insertion and removal of the at least panel to and from the groove of the frame.

10. A method of installing a panel into a frame of a wall element according to claim 7, the method comprising:

(e) inserting the panel into the receptive groove of the frame of the body of the wall element, and (f) securing the panel into the frame by attaching the cover strip onto the panel and frame through the reversible attachment interface between the cover strip and the body.

11. The method according to claim 10, comprising:

(d) bending the panel into a non-planar state before the insertion step (e).

12. A method of replacing a panel of a wall element according to claim 7, the method comprising:

(a) releasing an old panel from the frame of the body of the wall element by detaching the cover strip from the panel and frame through the reversible attachment interface between the cover strip and the body;

(b) removing the old panel from the receptive groove of the frame of the body of the wall element, and (c) inserting a new panel into the receptive groove of the frame of the body of the wall element, and (d) securing the new panel into the frame by attaching the cover strip onto the panel and frame through the reversible attachment interface between the cover strip and the body.

13. The method according to claim 12, wherein step (b) comprises bending the panel into a non-planar state before said removal.

* * * * *